US011600209B2

(12) United States Patent
Gao

(10) Patent No.: US 11,600,209 B2
(45) Date of Patent: Mar. 7, 2023

(54) DISPLAY ASSEMBLY AND DISPLAY APPARATUS

(71) Applicant: BOE TECHNOLOGY GROUP CO., LTD., Beijing (CN)

(72) Inventor: Meiling Gao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/476,771

(22) Filed: Sep. 16, 2021

(65) Prior Publication Data

US 2022/0101761 A1 Mar. 31, 2022

(30) Foreign Application Priority Data

Sep. 28, 2020 (CN) ..... 202011042514.5

(51) Int. Cl.
*G09F 9/30* (2006.01)

(52) U.S. Cl.
CPC ..... *G09F 9/301* (2013.01)

(58) Field of Classification Search
CPC ..... G09F 9/301; G06F 1/1652; G06F 2203/04102
See application file for complete search history.

(56) References Cited

U.S. PATENT DOCUMENTS 9,173,287 B1 * 10/2015 Kim ..... G06F 1/1681
10,963,014 B1 * 3/2021 Park ..... G06F 1/1652
2016/0081204 A1 * 3/2016 Park ..... H04M 1/0268 361/807
2017/0061836 A1 * 3/2017 Kim ..... G06F 1/1626
2018/0124937 A1 * 5/2018 Choi ..... G06F 1/1652
2019/0297736 A1 * 9/2019 Xu ..... G06F 1/1656
2020/0008309 A1 * 1/2020 Kim ..... H01L 51/5253
2020/0068725 A1 * 2/2020 Park ..... H05K 5/0017
2021/0007230 A1 * 1/2021 Kang ..... H05K 5/0017
2021/0051809 A1 * 2/2021 Song ..... G06F 1/1652
2021/0337682 A1 * 10/2021 Zhu ..... G06F 1/1652
2021/0389809 A1 * 12/2021 Choi ..... G06F 1/1647
2022/0035407 A1 * 2/2022 Song ..... G06F 1/1624
2022/0037600 A1 * 2/2022 Song ..... H01L 51/5237
2022/0066510 A1 * 3/2022 Cha ..... G06F 1/1677
2022/0248548 A1 * 8/2022 Zhong ..... H05K 5/0017

FOREIGN PATENT DOCUMENTS

CN 106652802 A * 5/2017
CN 110058444 A * 7/2019 ..... G02F 1/133305
CN 210691893 U * 6/2020
WO WO-2021151506 A1 * 8/2021

* cited by examiner

*Primary Examiner* — Joe H Cheng
(74) *Attorney, Agent, or Firm* — Dority & Manning, P.A.

(57) ABSTRACT

A display assembly has a planar region and an edge bending region that are connected to each other. The display assembly includes a display panel, and a first support portion fixedly connected to a portion of the display panel located in the edge bending region. The first support portion includes a plurality of first support bars, and the plurality of first support bars are spaced apart in a width direction of the edge bending region. Materials of the plurality of first support bars are rigid materials.

19 Claims, 5 Drawing Sheets

DISPLAY ASSEMBLY AND DISPLAY APPARATUS

CROSS-REFERENCE TO RELATED APPLICATION

This application claims priority to Chinese Patent Application No. 202011042514.5, filed on Sep. 28, 2020, which is incorporated herein by reference in its entirety.

TECHNICAL FIELD

The present disclosure relates to the field of display technologies, and in particular, to a display assembly and a display apparatus.

BACKGROUND

With development of display technologies and ever-increasing requirements for the user experience, curved display apparatuses emerge as the times require. A display panel of a curved display apparatus is in a curved shape with a certain radian. Compared with a flat display apparatus, the curved display apparatus has a larger viewing angle and may provide users with better visual experience.

SUMMARY

In an aspect, a display assembly is provided. The display assembly has a planar region and at least one edge bending region that are connected to each other. The display assembly includes a display panel, and at least one first support portion fixedly connected to a portion of the display panel located in an edge bending region. A first support portion includes a plurality of first support bars, and the plurality of first support bars are spaced apart in a width direction of the edge bending region. Materials of the plurality of first support bars are rigid materials.

In some embodiments, a width of a first support bar is in a range of 0.2 mm to 1 mm, inclusive.

In some embodiments, the first support portion further includes a plurality of second support bars; the plurality of first support bars and the plurality of second support bars are alternately arranged in the width direction of the edge bending region, and any adjacent first support bar and second support bar are fixedly connected; and materials of the plurality of second support bars are elastic materials.

In some embodiments, a width of a second support bar is in a range of 0.2 mm to 1 mm, inclusive.

In some embodiments, the first support portion further includes at least one support layer, and a support layer is disposed on a first surface or a second surface of a whole formed by the plurality of first support bars and the plurality of second support bars. The first surface is a surface of the whole formed by the plurality of first support bars and the plurality of second support bars that is proximate to a display surface of the display panel, and the second surface is a surface of the whole formed by the plurality of first support bars and the plurality of second support bars that is away from the display surface of the display panel. A material of the support layer is an elastic material.

In some embodiments, the at least one support layer and the plurality of second support bars are of an integral structure.

In some embodiments, the display panel is bent to a back surface of the first support portion around the first support portion. The back surface of the first support portion is a surface of the first support portion away from the display surface of the display panel, and surfaces of the first support portion that are proximate to and away from the display surface of the display panel are both fixedly connected to the display panel.

In some embodiments, the portion of the display panel located in the edge bending region adheres to the first support portion through an adhesive layer; and in the edge bending region, an outer edge of the adhesive layer is closer to the planar region than an outer edge of the first support portion. The outer edge of the adhesive layer is an edge of the adhesive layer away from the planar region, and the outer edge of the first support portion is an edge of the first support portion away from the planar region.

In some embodiments, a portion of the first support portion extends to the planar region.

In some embodiments, a thickness of the first support portion is approximately 2.5 to 15 times a thickness of the display panel.

In some embodiments, the display assembly further includes a second support portion. The second support portion is fixedly connected to a portion of the at least one first support portion located in the edge bending region; the second support portion is attached to a portion of the display panel located in the planar region; and a material of the second support portion is a rigid material.

In another aspect, another display assembly is provided. The display assembly has a planar region and at least one edge bending region that are connected to each other. The display assembly includes a display panel, at least one first support portion fixedly connected to a portion of the display panel located in an edge bending region. A material of a first support portion is an elastic material, and an elastic modulus of the first support portion is greater than an elastic modulus of the display panel.

In some embodiments, the display panel is bent to a back surface of the first support portion around the first support portion. The back surface of the first support portion is a surface of the first support portion away from a display surface of the display panel, and surfaces of the first support portion that are proximate to and away from the display surface of the display panel are both fixedly connected to the display panel.

In some embodiments, the portion of the display panel located in the edge bending region adheres to the first support portion through an adhesive layer; and in the edge bending region, an outer edge of the adhesive layer is closer to the planar region than an outer edge of the first support portion. The outer edge of the adhesive layer is an edge of the adhesive layer away from the planar region, and the outer edge of the first support portion is an edge of the first support portion away from the planar region.

In some embodiments, a portion of the first support portion extends to the planar region.

In some embodiments, a thickness of the first support portion is approximately 2.5 to 15 times a thickness of the display panel.

In some embodiments, the display assembly further includes a second support portion. The second support portion is fixedly connected to a portion of the at least one first support portion located in the edge bending region; the second support portion is attached to a portion of the display panel located in the planar region; and a material of the second support portion is a rigid material.

In yet another aspect, a display apparatus is provided. The display apparatus includes the display assembly as described in any of the above embodiments. The display apparatus further includes a cover plate and an optically clear adhesive layer. The optically clear adhesive layer is located between the display assembly and the cover plate, and the cover plate and a display surface of the display assembly adhere through the optically clear adhesive layer.

BRIEF DESCRIPTION OF THE DRAWINGS

In order to describe technical solutions in the present disclosure more clearly, the accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings in the following description can be regarded as schematic diagrams, but are not limitations on actual sizes of products, actual processes of methods and actual timings of signals to which the embodiments of the present disclosure relate.

DETAILED DESCRIPTION

Figure 1:
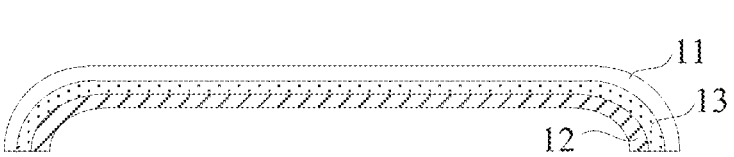
FIG. 1 is a diagram showing structures of a display panel, an adhesive layer, and a support in a curved display apparatus, in accordance with some embodiments.

Technical solutions in some embodiments of the present disclosure will be described clearly and completely below with reference to the accompanying drawings. However, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment," "some embodiments," "exemplary embodiments," "example," "specific example," or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Hereinafter, the terms"first" and "second" are only used for descriptive purposes, and are not to be construed as indicating or implying relative importance or implicitly indicating the number of indicated technical features. Thus, features defined by "first" or "second" may explicitly or implicitly include one or more of the features. In the description of the embodiments of the present disclosure, the term "a plurality of", "the plurality of", or "multiple" means two or more unless otherwise specified.

In the description of some embodiments, the terms "coupled" and "connected" and their extensions may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The phrase "at least one of A, B and C" has a same meaning as the phrase "at least one of A, B or C", and they both include the following combinations of A, B and C: only A, only B, only C, a combination of A and B, a combination of A and C, a combination of B and C, and a combination of A, B and C.

The phrase "A and/or B" includes the following three combinations: only A, only B, and a combination of A and B.

The use of the phrase "applicable to" or "configured to" means an open and inclusive language, which does not exclude apparatuses that are applicable to or configured to perform additional tasks or steps.

In addition, the use of the phrase "based on" is meant to be open and inclusive, since a process, step, calculation or other action that is "based on" one or more of the stated conditions or values may, in practice, be based on additional conditions or values beyond those stated.

Terms such as "about", "substantially", or "approximately" as used herein include a stated value and an average value within an acceptable range of deviation of a particular value. The acceptable range of deviation is determined by a person of ordinary skill in the art in view of the measurement in question and the error associated with the measurement of a particular quantity (i.e., the limitations of the measurement system).

Terms such as "parallel," "perpendicular," or "equal" as used herein include a stated condition and a condition similar to the stated condition. A range of the similar condition is within an acceptable deviation range, and the acceptable deviation range is determined by a person of ordinary skill in the art in view of the measurement in question and the error associated with the measurement of a particular quantity (i.e., the limitations of a measurement system). For example, the term "parallel" includes absolute parallel and approximate parallel, and the acceptable deviation range of the approximate parallel may be, for example, a deviation within 5°. The term "perpendicular" includes absolute perpendicular and approximate perpendicular, and the acceptable deviation range of the approximate perpendicular may also be, for example, a deviation within 5°. The term "equal" includes absolute equal and approximate equal, and the acceptable deviation range of the approximate equal may be that, for example, a difference between the two that are equal is less than or equal to 5% of either of the two.

Exemplary embodiments are described herein with reference to sectional views and/or plan views as idealized exemplary drawings. In the accompanying drawings, thicknesses of layers and sizes of regions are enlarged for clarity. Therefore, variations in shapes with respect to the drawings due to, for example, manufacturing technologies and/or tolerances may be envisaged. Therefore, the exemplary embodiments should not be construed as being limited to the shapes of the regions shown herein, but including deviations in the shapes due to, for example, manufacturing. For example, an etched region shown in a rectangular shape generally has a curved feature. Therefore, the regions shown in the accompanying drawings are schematic in nature, and their shapes are not intended to show actual shapes of the regions in a device, and are not intended to limit the scope of the exemplary embodiments.

Referring to FIG. 1, a curved display apparatus 1 includes a display panel 11, a support 12, and an adhesive layer 13. Since the display panel 11 of the curved display apparatus 1 is a flexible display panel, it cannot maintain a specific curved surface only in some regions and maintain a straight surface shape in other regions. Therefore, the support 12 is provided to limit a shape of the display panel. The material of the support 12 is generally stainless steel. A portion of a surface of the support 12 proximate to the display panel 11 is a flat surface, and a remaining portion is a curved surface with a certain radian. The display panel 11 may be attached to the surface of the support 12 through the adhesive layer 13, so that the shape of the display panel 11 is consistent with a shape of the surface of the support 12. As a result, the shape of the display panel is maintained such that some regions thereof are curved surfaces, whereas other regions thereof are flat surfaces. However, since the material of the support 12 is stainless steel, a curved shape formed by the support 12 is fixed and will not be deformed after being formed. The display panel 11 is a flexible display panel, which will rebound after deformation (e.g., bending). Therefore, a rebounded portion of the display panel 11 will peel off from the support 12, resulting in a low yield of the curved display apparatus 1, which is not conducive to mass production of the curved display apparatus.

Figure 2:
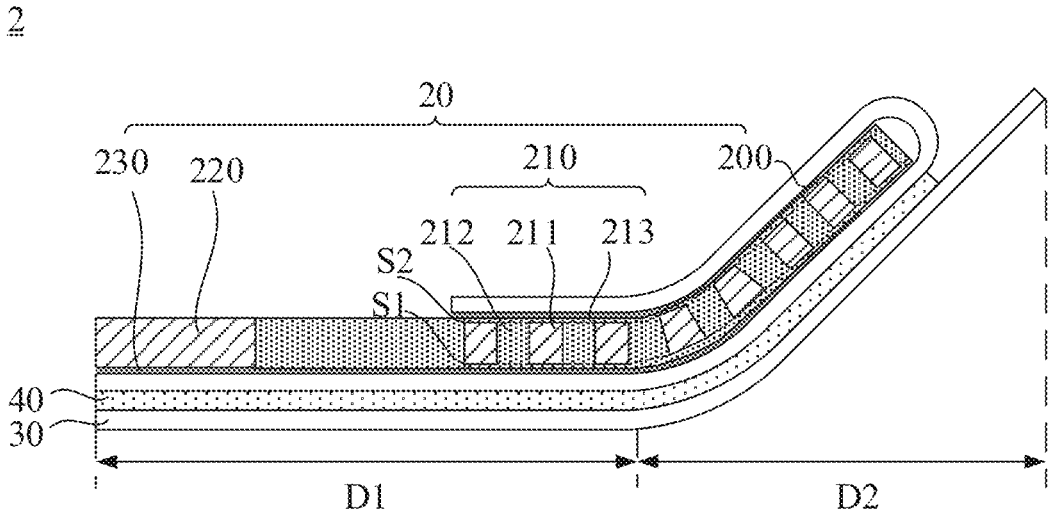
FIG. 2 is a diagram showing a structure of a display apparatus, in accordance with some embodiments.

In order to solve the above technical problem, in an aspect, referring to FIG. 2, some embodiments of the present disclosure provide a display apparatus 2. For example, the display apparatus 2 may be: a display, a television, a billboard, a digital photo frame, a palm computer, a smart watch, a laser printer with a display function, a telephone, a mobile phone, a personal digital assistant (PDA), a digital camera, a portable video camera, a viewfinder, a navigator, a home appliance, or an information query equipment (e.g. business query equipment of e-government, banking, hospital, power and other sectors). A form of the display apparatus 2 is not limited, and the display apparatus 2 may be a sliding display apparatus, a folding display apparatus, a stretchable display apparatus, and the like.

For example, with continued reference to FIG. 2, the display apparatus 2 includes a display assembly 20 configured to display images, and the display assembly 20 includes a display panel 200. The display panel 200 is a flexible display panel that may be deformable and bendable. For example, the display panel 200 may be an organic light-emitting diode (OLED) display panel, a quantum dot light-emitting diode (QLED) display panel, etc. The display panel 200 has a display surface. A surface where the display panel 200 can display images and the displayed images can be seen by the user is the display surface of the display panel 200.

In addition, for example, the display assembly 20 may further include a polarizing layer. The polarizing layer is disposed on a side where the display surface of the display panel 200 is located, and is configured to reduce adverse effects of incidence and reflection of external ambient light on a display effect of the display assembly 20. The display assembly 20 may further include a touch layer for implementing a touch function, and the touch layer may be arranged by adopting an on-cell touch technology, an in-cell touch technology, or an add-on touch technology. Of course, the display assembly 20 may also include structural components and other layers that are necessary for achieving its basic functions and are commonly used in the related art, which is not limited in the embodiments of the present disclosure.

Figure 3:
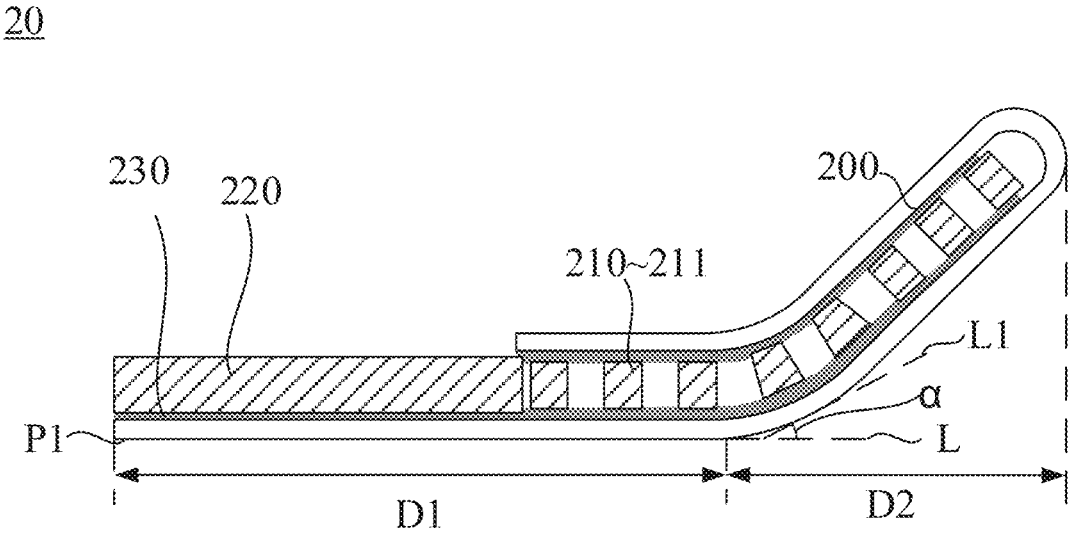
FIG. 3 is a diagram showing a structure of a display assembly, in accordance with some embodiments.
Figure 4:
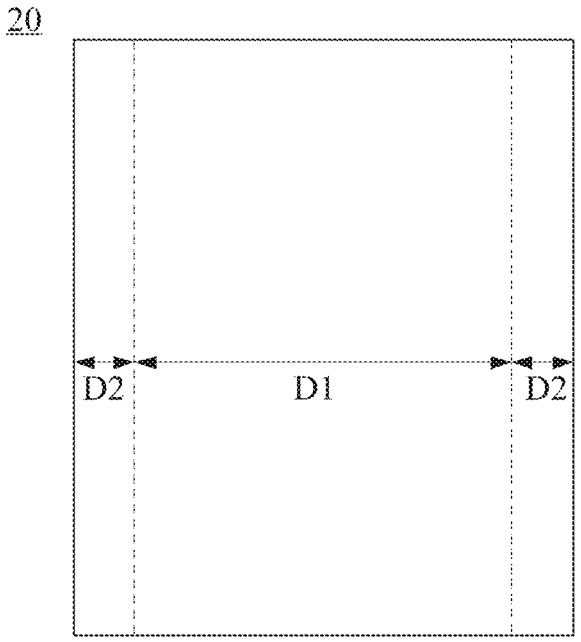
FIG. 4 is a diagram showing a structure of a display assembly having a planar region and an edge bending region, in accordance with some embodiments.
Figure 5:
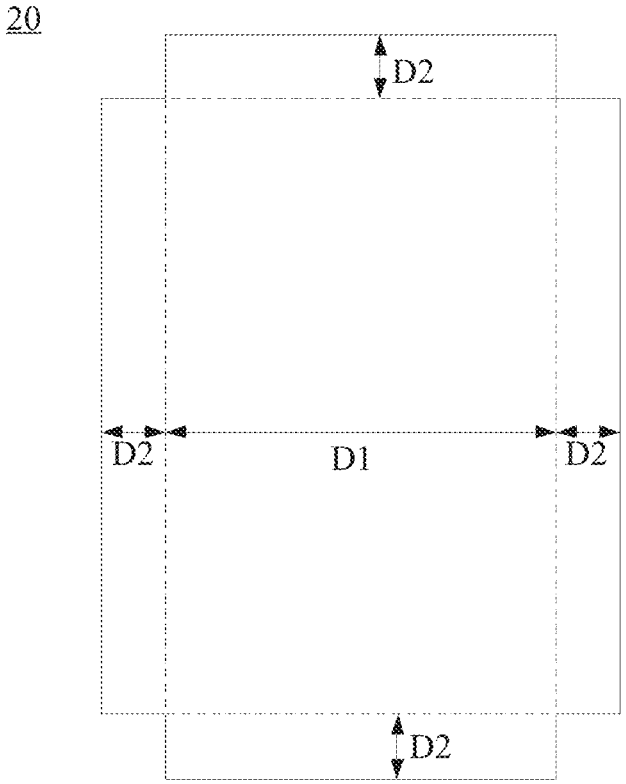
FIG. 5 is a diagram showing a structure of another display assembly having a planar region and an edge bending region, in accordance with some embodiments.

For example, referring to FIG. 3, the display assembly 20 has a planar region D1 and at least one edge bending region D2 that are connected to each other. A portion of the display panel 200 is disposed in the planar region D1, and at least one remaining portion is disposed in the edge bending region D2. In the embodiments of the present disclosure, a size of the planar region D1 may be set based on an application scenario, which is not limited. The display assembly 20 may have only one edge bending region D2 or include a plurality of edge bending regions D2. For example, the display assembly 20 has the planar region D1 and one edge bending region D2, and the one edge bending region D2 is connected to the planar region D1. In this case, one remaining portion of the display panel 200 is disposed in the one edge bending region D2. For another example, referring to FIG. 4, the display assembly 20 has the planar region D1 and two edge bending regions D2, and the two edge bending regions D2 are both connected to the planar region D1. In this case, two remaining portions of the display panel 200 are respectively disposed in the two edge bending region D2. For yet another example, referring to FIG. 5, the display assembly 20 has the planar region D1 and four edge bending regions D2, and the four edge bending regions D2 are all connected to the planar region D1. In this case, four remaining portions of the display panel 200 are respectively disposed in the four edge bending region D2. Taking the display assembly 20 having one edge bending region D2 as an example, the planar region D1 is connected to the edge bending region D2. The portion of the display panel 200 located in the planar region D1 is flat, and the portion of the display panel 200 located in the edge bending region D2 is bent toward a back surface of the display surface of the display panel 200. A plane where a portion of the display surface of the display panel 200 located in the planar region D1 is located is a first plane P1, and a straight line where a tangent of a portion of the display surface of the display panel 200 located in the edge bending region D2 is located is a first straight line L1. An included angle between the first straight line L1 and the first plane P1 is a first included angle α. Since a display surface of a bent display panel 200 has a plurality of tangents, there are a plurality of first straight lines L1, and correspondingly, there are a plurality of first included angles α. At a connecting position of the planar region D1 and the edge bending region D2, the first included angle α between the first straight line L1 and the first plane P1 is 0°, and the first straight line L1 at the connecting position is referred to as a representative straight line L. Except for the representative straight line L, an angle value of any first included angle α is greater than 0°.

For example, with continued reference to FIG. 2, the display apparatus 2 may further include a cover plate 30 and an optically clear adhesive (OCA) layer 40 besides the display assembly 20 described above. The optically clear adhesive layer 40 is located between the display assembly 20 and the cover plate 30, and the cover plate 30 and the display surface of the display assembly 20 adhere through the optically clear adhesive layer 40. The display surface of the display assembly 20 is a surface of one of layers in the display assembly 20 that is closest to the cover plate 30. The cover plate 30 is disposed on a side proximate to the display surface of the display assembly 20, and is configured to protect the display assembly 20. The optically clear adhesive layer 40 is used to achieve an adherence between the display assembly 20 and the cover plate 30. For example, a material of the optically clear adhesive layer 40 may be organic silicone rubber (also referred to as organosiloxane or silicone rubber), acrylic resin, unsaturated polyester, polyurethane (PU), phenolic epoxy resin, etc. The cover plate 30 may be a flexible cover plate, and a material of the flexible cover plate may be polyethylene terephthalate (PET), polyethylene naphthalate (PEN), or polyimide (PI), etc. In a case where the cover plate 30 is a flexible cover plate, a shape of the flexible cover plate 30 may be a plane. When the curved display apparatus 2 is manufactured, referring to FIG. 6, the display assembly 20 may adhere to the flexible cover plate 30 through the optically clear adhesive layer 40, and then the flexible cover plate 30 and the display assembly 20 that adhere are bent, so as to form the curved display apparatus 2 shown in FIG. 7 in which a portion of the surface located in the planar region D1 is a flat surface, and a portion of the surface located in the edge bending region D2 is in a curved shape with a certain radian.

It will be understood that, since the flexible cover plate has good bending performance, it can achieve not only bending of opposite sides, but also bending of all four sides of the cover plate. In addition, the flexible cover plate is beneficial to form a curved surface with a large curvature in the edge bending region to increase a viewing angle. Moreover, when the display assembly 20 is attached to the flexible cover plate, a risk of appearance of wrinkles and bubbles at a position corresponding to the curved surface is low, which can ensure a yield of a product. In this way, a seamlessly attached curved display apparatus 2 with a large curvature may be obtained.

In some embodiments, the display apparatus 2 may further include structural components such as a limiting piece. For example, the limiting piece is configured to fix the shape of the display assembly 20 such that the portion of the surface located in the planar region D1 is a flat surface, and the portion of the surface located in the edge bending region D2 is in a curved shape with a certain radian. For example, the limiting piece may be a housing, and the flexible cover plate 30 and the display assembly 20 that are attached to each other may be fixed in the housing by dispensing glue around them to obtain the curved display apparatus 2.

In another aspect, with continued reference to FIG. 3, some embodiments of the present disclosure provide a display assembly 20. The display assembly 20 includes the display panel 200 as described above, and further includes at least one first support portion 210 fixedly connected to a portion of the display panel 200 located in an edge bending region D2. The number of the at least one first support portion 210 may be set according to the number of the at least one edge bending region D2. For example, the numbers of the two are the same. A first support portion 210 may be only disposed in an edge bending region D2, or may be partially disposed in the planar region D1, and partially disposed in the edge bending region D2, which is not limited. A portion of the display panel 200 disposed in the edge bending region D2 is fixedly connected to the first support portion 210. The fixed connection is for connecting different components as a whole. A specific connection manner used for the fixed connection is not limited, for example, mechanical connection or adherence may be used. For example, referring to FIG. 3, the portion of the display panel 200 located in the edge bending region D2 and the first support portion 210 are fixedly connected by adhering. That is, an adhesive layer is provided between a portion, opposite to the first support portion 210, of the display panel 200 and the first support portion 210, so as to make the two adhere together as a whole. A material of the adhesive layer may be pressure sensitive adhesive (PSA).

Figure 6:
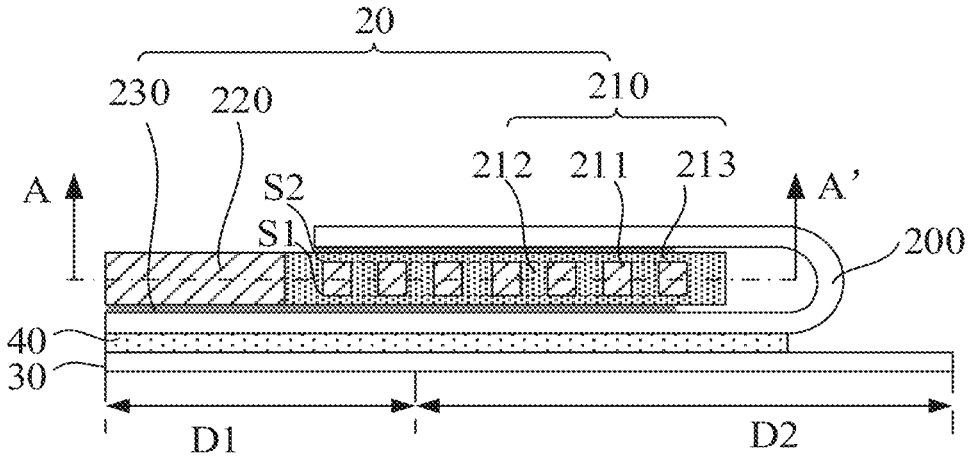
FIG. 6 is a diagram showing a structure of a fixed connection between a display assembly and a cover plate, in accordance with some embodiments.
Figure 8:
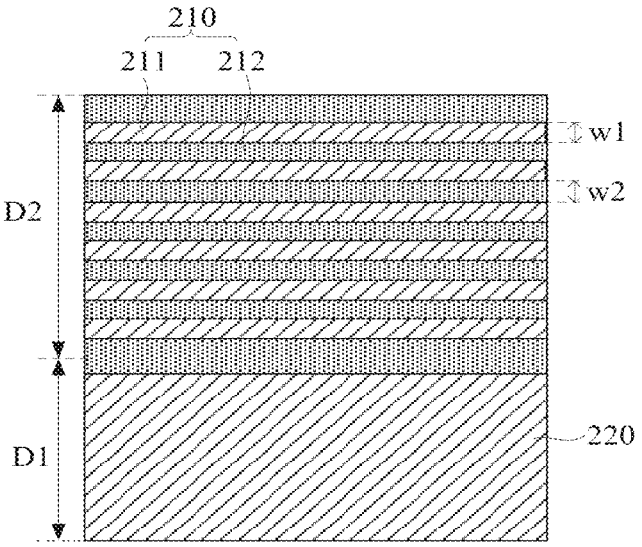
FIG. 8 is a sectional view taken along the line A-A' in FIG. 6, in accordance with some embodiments.

With continued reference to FIG. 3, the first support portion 210 includes a plurality of first support bars 211, the plurality of first support bars 211 are spaced apart in a width direction of the edge bending region D2. The width direction of the edge bending region D2 is a direction parallel with the representative straight line L and extends to a side away from the planar region D1, i.e., a direction from the planar region D1 to the edge bending region D2. The materials of the plurality of first support bars 211 are rigid materials. The rigid material refers to a material that has good resistance to deformation under action of an external force, that is, a material that is not deformed or is deformed to a very small extent (that is, a degree of deformation is very small and invisible to naked eyes) under action of the external force. The rigid material may be metal, alloy, composite material, ceramic, hard plastic, glass, etc. For example, the materials of the plurality of first support bars 211 are all stainless steel. An extending direction of each first support bar 211 is perpendicular to the width direction of the edge bending region D2, and any two adjacent first support bars 211 are substantially parallel. The expression "substantially parallel" means that extending directions of any two adjacent first support bars 211 are parallel, or an included angle between the extending directions of any two adjacent first support bars 211 does not exceed 5°. For example, two opposite surfaces in the extending direction of the first support bar 211 are side faces of the first support bar 211. Two opposite side faces of a same first support bar 211 have a same shape. Shapes of side faces of the plurality of first support bars 211 may be the same or different. In some examples, the side face of the first support bar 211 may be in a shape of a rectangle, a trapezoid, a square, a circle, a regular hexagon, or the like. For example, referring to FIG. 3, the shapes of the side faces of the plurality of first support bars 211 are different, side faces of some first support bars 211 are in a rectangular shape, and side faces of the other first support bars 211 are in a trapezoidal shape. For another example, as shown in FIG. 6, the shapes of the side faces of the plurality of first support bars 211 are the same and are all rectangles, and referring to FIG. 8, the extending directions of any two adjacent first support bars 211 are parallel.

With continued reference to FIG. 3, the plurality of first support bars 211 are spaced apart in the width direction of the edge bending region D2, and each first support bar 211 is fixedly connected to the display panel 200, that is, there is a gap between any two adjacent first support bars 211. Since the display panel 200 is a flexible display panel 200 that is deformable and bendable, and there is a gap between any two adjacent first support bars 211, the whole (hereinafter referred to as a connected whole) including the plurality of first support bars 211 and the display panel 200 that are fixedly connected may be bent. As a result, the portion of the display panel 200 located in the edge bending region D2 may form a curved shape with a certain radian, so that the connected whole may be used to manufacture the curved display apparatus 2 with a large viewing angle. In addition, in the connected whole of the embodiments of the present disclosure, a deformation of either one will cause another to deform accordingly, which may avoid a problem of peeling off of the display panel 200 from the support with a fixed shape after the display panel 200 rebounds, thereby effectively improving the yield of the product (i.e., the display assembly 20), helping to achieve mass production, and ensuring a connection reliability of an overall structure of the display assembly 20 in a subsequent use of the product and service life of the product. Moreover, in the above arrangement, the connected whole may form the curved display apparatus 2 with the large curvature, which is beneficial to achieve a large viewing angle. Furthermore, since the material of the first support bar 211 is the rigid material, it may still support the display panel 200 on the premise that it is beneficial to form the curved surface and avoid peeling off of the display panel 200 from the first support portion 210, so that the portion of the display panel 200 located in the edge bending region D2 will not be excessively deformed due to the press by the user's fingers, which will not adversely affect a display effect of the curved display apparatus 2. In addition, in a case where the cover plate 30 of the display apparatus 2 is the flexible cover plate, the connected whole in the above arrangement adheres to the cover plate 30. In the edge bending region D2 of the display assembly 20, when the cover plate 30 rebounds and deforms after being bent, the connected whole may also be deformed with the deformation of the cover plate 30, which may avoid peeling off between the cover plate 30 and the display panel 200 in the display assembly 20 caused by rebound.

In some embodiments, a width of the first support bar 211 is in a range of 0.2 mm to 1 mm, inclusive. In a case where the material of the first support bar 211 is the rigid material, the first support bar 211 within the width range can provide effective support for the display panel 200. Moreover, it is easy to form the first support bar 211 in a process, and a manufacturing difficulty is small, which is beneficial to control a production cost. In addition, since the first support bar 211 has a relatively small width, when the connected whole is bent, an appearance of the display assembly 20 does not produce obvious "ribs", which may avoid affecting the user experience. For example, referring to FIG. 8, the widths w1 of the first support bars 211 may all be within a range of a difference between 0.5 mm and 0.1 mm to a sum of 0.5 mm and 0.1 mm (0.5±0.1 mm).

Figure 7:
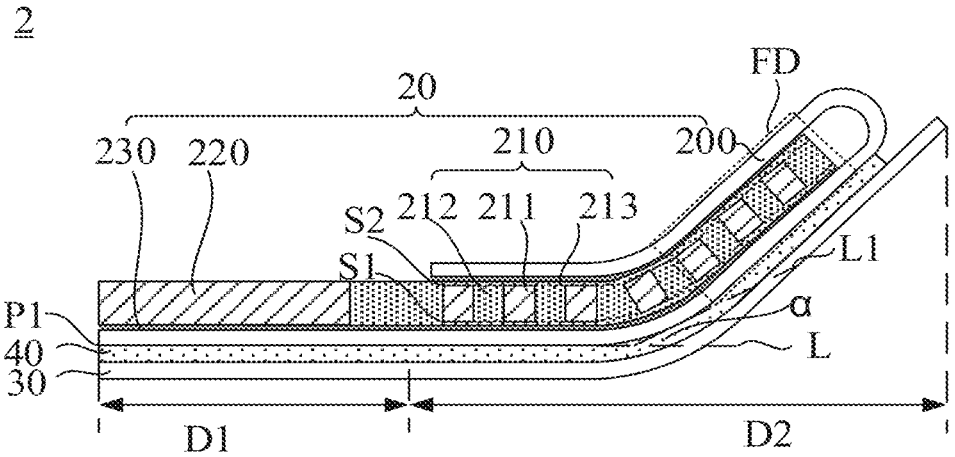
FIG. 7 is a diagram showing a structure of another display apparatus, in accordance with some embodiments.

In some embodiments, with continued reference to FIG. 7, the first support portion 210 further includes a plurality of second support bars 212. The plurality of first support bars 211 and the plurality of second support bars 212 are alternately arranged in the width direction of the edge bending region D2, and any adjacent first support bar 211 and second support bar 212 are fixedly connected. That is, the connected whole further includes the plurality of second support bars 212. In the width direction of the edge bending region D2, a first support bar 211 is provided between any two adjacent second support bars 212, and any adjacent first support bar 211 and second support bar 212 are fixedly connected. For example, that any adjacent first support bar 211 and second support bar 212 are fixedly connected may be that side faces of the first support bar 211 and the second support bar 212 that are proximate to each other directly adhere or adhere through an adhesive layer, so that there will be no relative displacement between the side faces of the first support bar 211 and the second support bar 212 that are proximate to each other. Materials of the plurality of second support bars 212 are elastic materials. The elastic material refers to a material that is deformed to a relatively large extent under the action of the external force, and may quickly return to an original shape after the external force is removed. In a case where a material of the second support bar 212 is an elastic material, and any adjacent first support bar 211 and second support bar 212 are fixedly connected, when the connected whole is bent, the second support bar 212 can fill gaps among side faces of the two adjacent first support bars 211 that are proximate to each other and the display panel 200, thereby providing effective support for the display panel 200, further ensuring that the portion of the display panel 200 located in the edge bending region D2 will not be deformed due to the press by the user's fingers, and avoiding adverse effects on the display effect of the curved display apparatus 2.

For example, the materials of the plurality of second support bars 212 may be the same or different, which will not limited. In some examples, the material of the second support bar 212 may be a rubber material such as silica gel, polyethylene terephthalate or thermoplastic polyolefin (TPO), thermoplastic elastomer (TPE), etc. For example, the material of the second support bar 212 may be silica gel. Silica gel has good physicochemical property, and is a fairly stable inert substance since it can maintain original elasticity and softness during contact with body fluids and tissues and cannot degrade. Moreover, silica gel has properties of high temperature resistance, low temperature resistance, corrosion resistance, and aging resistance, and convenient processing and molding. As a result, it is possible to ensure reliability of the connected whole, reduce difficulty of manufacturing the connected whole, and facilitate the controlling of the production cost.

In some embodiments, a width of the second support bar 212 is in a range of 0.2 mm to 1 mm, inclusive. Similar to the width of the first support bar 211 within the range of 0.2 mm to 1 mm, the width of the second support bar 212 is set within the above width range, which may also achieve effects of controlling the production cost and improving the user experience. For example, referring to FIG. 8, the widths w2 of the second support bars 212 may all be within a range of a difference between 0.5 mm and 0.1 mm to a sum of 0.5 mm and 0.1 mm (0.5±0.1 mm).

Figure 9:
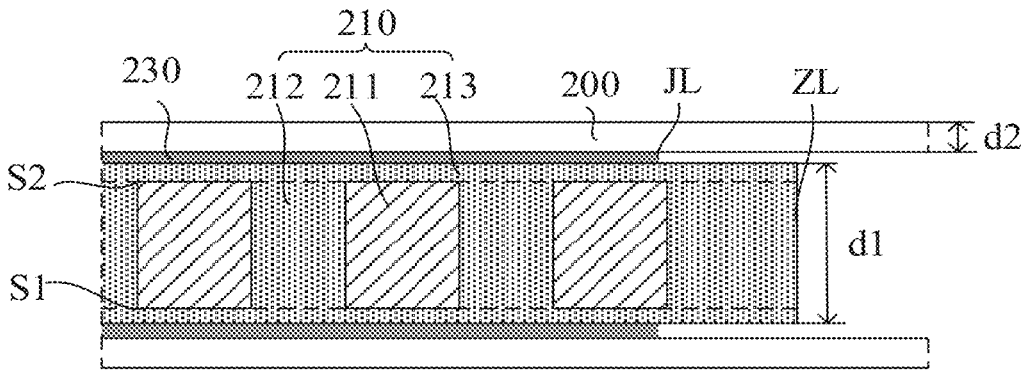
FIG. 9 is an enlarged view of a region FD in FIG. 7, in accordance with some embodiments.
Figure 10:
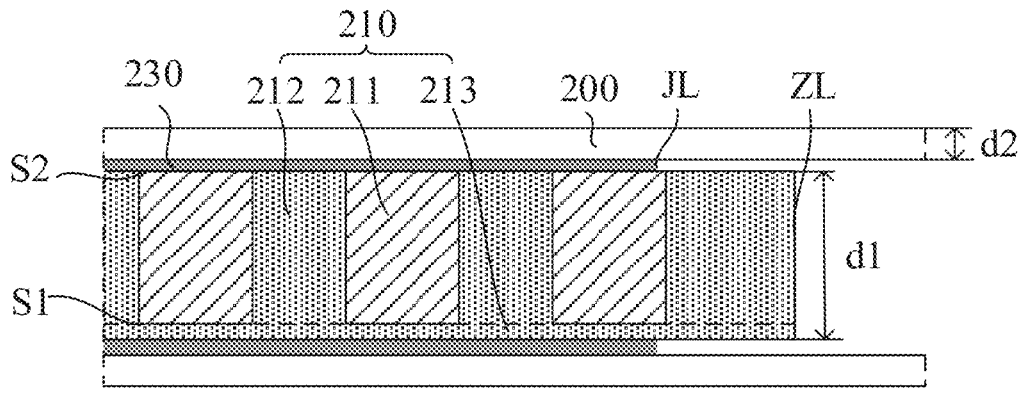
FIG. 10 is another enlarged view of a region FD in FIG. 7, in accordance with some embodiments.
Figure 11:
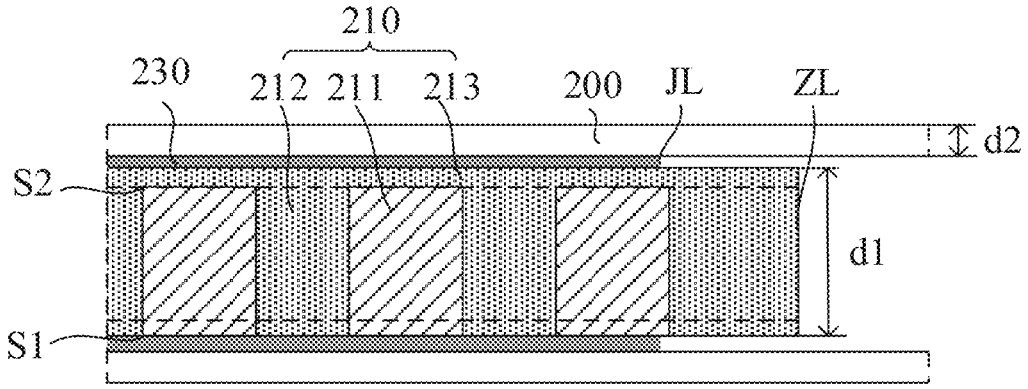
FIG. 11 is yet another enlarged view of a region FD in FIG. 7, in accordance with some embodiments.

In some embodiments, referring to FIGS. 7 and 9, the first support portion 210 further includes at least one support layer 213 (e.g., two support layers 213), and a support layer 213 is disposed on a first surface S1 or a second surface S2 of a whole formed by the plurality of first support bars 211 and the plurality of second support bars 212. The first surface S1 is a surface of the whole formed by the plurality of first support bars 211 and the plurality of second support bars 212 that is proximate to the display surface of the display panel 200, and the second surface S2 is a surface of the whole formed by the plurality of first support bars 211 and the plurality of second support bars 212 that is away from the display surface of the display panel 200. A material of the support layer 213 is an elastic material. An optional elastic material of the support layer 213 is the same as an optional elastic material of the second support bar 212, and will not be repeated here. Materials of the support layer 213 and the second support bar 212 may be the same or different, which is not limited. Referring to FIG. 10, the support layer 213 may be only disposed on the first surface S1, and fixedly connected to the first surface S1. Referring to FIG. 11, the support layer 213 may also be only disposed on the second surface S2, and fixedly connected to the second surface S2. Referring to FIG. 9, the support layer 213 may also be disposed on the first surface S1 and the second surface S2, and fixedly connected to both surfaces. An arrangement of the support layer 213 may improve tightness of a fixed connection between the first support bar 211 and the second support bar 212, so that peeling off does not easily occur between the fixedly connected first support bar 211 and second support bar 212. As a result, reliability of structural connections may be improved. For example, referring to FIGS. 7 and 9, at least one (e.g., each) support layer 213 and the plurality of second support bars 212 are integrally formed. That is, the at least one support layer 213 and the plurality of second support bars 212 are of an integral structure. Materials of the support layer 213 and the plurality of second support bars 212 are the same, and the support layer 213 and the plurality of second support bars 212 may form, by compression molding or injection molding, a whole with a complete and seamless surface, so that the support layer 213 wraps and covers the plurality of first support bars 211 and the plurality of second support bars 212, which may further improve tightness of a fixed connection among the first support bars 211, the second support bars 212, and the support layer 213. Moreover, it is beneficial to simplify a manufacturing process and optimize the production cost.

In some embodiments, with continued reference to FIG. 7, the display panel 200 is bent to a back surface of the first support portion 210 around the first support portion 210. The back surface of the first support portion 210 is a surface of the first support portion 210 away from the display surface of the display panel 200, and surfaces of the first support portion 210 that are proximate to and away from the display surface of the display panel 200 are both fixedly connected to the display panel 200. A portion of a surface of the display panel 200 proximate to the first support portion 210 and the first surface S1 have a first overlapping region. A portion of the display panel 200 corresponding to the first overlapping region and the first surface S1 adhere through an adhesive layer 230. A remaining portion of the surface of the display panel 200 proximate to the first support portion 210 and the second surface S2 have a second overlapping region. Similarly, a portion of the display panel 200 corresponding to the second overlapping region and the second surface S2 also adhere through an adhesive layer 230. In addition, two surfaces of the first support portion 210 that are proximate to and away from the display surface of the display panel 200 both adhere to the display panel 200 through the adhesive layer 230.

In the related art, the display panel 200 needs to be electrically connected to a driving integrated circuit (IC), so that the display panel 200 may be driven by the driving IC to display images. The display apparatus 2 usually has a peripheral region that is used to arrange the driving IC and cannot display images. An area of the peripheral region is relatively large due to a limitation of a size and volume of the driving IC, poor visual experience will be brought to the user. However, in the embodiments of the present disclosure, the driving IC may be disposed on a side of the display assembly 20 away from the display surface of the display panel 200, and the display panel 200 may be bent to the back surface of the first support portion 210 around the first support portion 210. A portion of the display panel 200 that is bent to the back surface of the first support portion 210 may be electrically connected to the driving IC disposed on the side of the display assembly 20 away from the display surface of the display panel 200 (i.e., the back surface of the first support portion 210), so that the area of the peripheral region may be reduced, and the display effect of the display apparatus 2 may be improved. In addition, since the display panel 200 adheres to the first surface S1 and the second surface S2 through the adhesive layer 230, the connection reliability may be high, and a risk of peeling off of the display panel 200 may be further reduced.

In some embodiments, referring to FIG. 9, the portion of the display panel 200 located in the edge bending region D2 adheres to the first support portion 210 through the adhesive layer 230. In the edge bending region D2, an outer edge JL of the adhesive layer 230 is closer to the planar region D1 than an outer edge ZL of the first support portion 210. The outer edge JL of the adhesive layer 230 is an edge of the adhesive layer 230 away from the planar region D1, and the outer edge ZL of the first support portion 210 is an edge of the first support portion 210 away from the planar region D1. Since the outer edge JL of the adhesive layer 230 is closer to the planar region D1 than the outer edge ZL of the first support portion 210, in an edge region of the first support portion 210 away from the planar region D1, the adhesive layer is not provided in a portion of an overlapping region between the display panel 200 and the first surface S1. Similarly, in the edge region, the adhesive layer is also not provided in a portion of an overlapping region between the display panel 200 and the second surface S2. This arrangement may prevent excessive stress generated in a portion of the display panel 200 that is located in the edge region and corresponds to an end of the first support portion 210 away from the planar region D1 when the display assembly 20 is bent to form a curved shape with a certain radian, thereby reducing a risk of damage to the portion of the display panel 200 due to excessive stress, which is beneficial to improve the yield of the product.

In some embodiments, with continued reference to FIG. 9, a thickness d1 of the first support portion 210 is approximately 2.5 to 15 times a thickness d2 of the display panel 200. In a case where a structure of the first support portion 210 is set in accordance with any of the forgoing embodiments, that the thickness d1 of the first support portion 210 is set to be approximately 2.5 to 15 times the thickness d2 of the display panel 200 may not only ensure that the first support portion 210 may be flexibly bent to avoid the peeling off of the display panel 200 due to rebound, but also have a sufficient support effect on the display panel 200, so that the portion of the display panel 200 located in the edge bending region D2 will not be excessively deformed due to the press by the user's fingers. As a result, the display effect of the curved display apparatus 2 will not be adversely affected. For example, referring to FIG. 9, a thickness range of the display panel 200 is from 25 to 45 μm, inclusive, and a thickness range of the first support portion 210 is from 100 to 500 μm, inclusive. For example, the thickness d2 of the display panel 200 is approximately 35 μm, and the thickness d1 of the first support portion 210 is approximately 2.5 to 15 times the thickness of the display panel 200, e.g., 10 times, and in this case, the thickness of the first support portion 210 d1 is approximately 350 μm.

It will be noted that specific values of the width of the first support bar 211, the width of the second support bar 212, the thickness d1 of the first support portion 210, and the thickness d2 of the display panel 200 may be set based on the application scenario, which will not be limited herein.

In some embodiments, with continued reference to FIG. 7, the display assembly 20 further includes a second support portion 220. The second support portion 220 is fixedly connected to a portion of the at least one first support portion 210 located in the edge bending region D2. The second support portion 220 is attached to the portion of the display panel 200 located in the planar region D1, and a material of the second support portion 220 is a rigid material. An optional material of the second support portion 220 is the same as the rigid material that the first support bar 211 may selectively use, and will not be repeated here. Materials of the second support portion 220 and the first support bar 211 may be the same or different, which will not be limited. The second support portion 220 made of the rigid material is disposed in the planar region D1, so that the second support portion 220 is attached to the portion of the display panel 200 located in the planar region D1. As a result, in the planar region D1, it is possible to provide effective support for the display panel 200, which may avoid excessive deformation of the display panel 200 under the action of the external force, and further ensure the display effect.

For example, referring to FIG. 7, a portion of the first support portion 210 may extend to the planar region D1. Since the material of the second support portion 220 is the rigid material, and the first support portion 210 and the second support portion 220 are fixedly connected, a position of an end of the first support portion 210 that is fixedly connected to the second support portion 220 may be defined by the second support portion 220. In this case, a shape of the first support portion 210 may be determined by defining a position of an end of the first support portion 210 away from the planar region D1, so that the first support portion 210 forms a curved surface with a certain radian, and a difficulty of fixing the shape of the first support portion 210 may be reduced. Moreover, the portion of the first support portion 210 extends to the planar region D1, and the second support portion 220 is fixedly connected to the portion of the first support portion 210 that is located in the planar region D1 and does not need to be bent. As a result, stress at a connecting position of the first support portion 210 and the second support portion 220 is small, a connecting structure is strong, and the risk of peeling off may be reduced.

Figure 12:
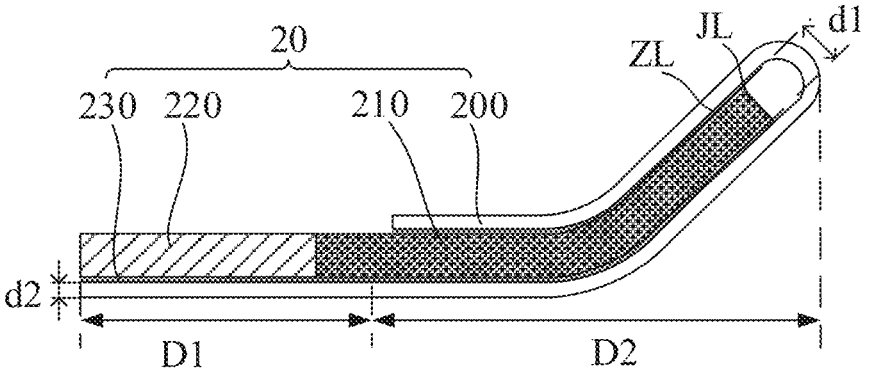
FIG. 12 is a diagram showing a structure of another display assembly, in accordance with some embodiments.
Figure 13:
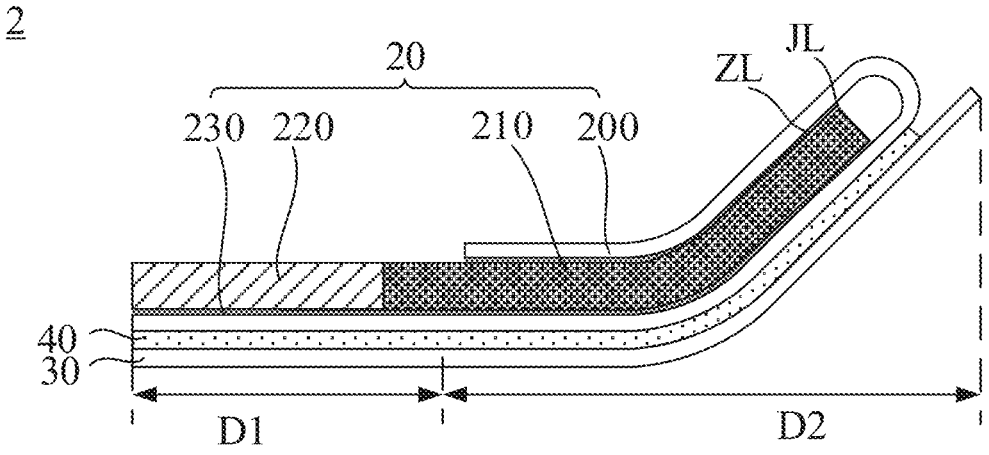
FIG. 13 is a diagram showing a structure of another display apparatus, in accordance with some embodiments.

In yet another aspect, referring to FIG. 12, some embodiments of the present disclosure provide another display assembly 20 and another display apparatus 2 including the display assembly 20 shown in FIG. 13. The display assembly 20 has a planar region D1 and at least one edge bending region D2 that are connected to each other. It includes the display panel 200 described above, and further includes at least one first support portion 210 fixedly connected to a portion of the display panel 200 located in the edge bending region D2. A structure setting of the display assembly 20 is the same as the structure setting of the display assembly 20 described above, and a difference is in that in the display assembly 20, a material of the first support portion 210 is an elastic material. An elastic modulus of the first support portion 210 shall be greater than an elastic modulus of the display panel 200, so that an effect that can be achieved by the first support portion 210 in the display assembly 20 is consistent with an effect that can be achieved by the first support portion 210 in the display assembly 20 described above, and it is also possible to ensure that the first support portion 210 can provide sufficient support for the display panel 200, which may avoid excessive deformation of the display panel 200. For example, the material of the first support portion 210 may be foam rubber (also referred to as foam, and sponge rubber).

In some embodiments, referring to FIG. 12, the display panel 200 is bent to a back surface of the first support portion 210 around the first support portion 210. The back surface of the first support portion 210 is a surface of the first support portion 210 away from a display surface of the display panel 200, and surfaces of the first support portion 210 that are proximate to and away from the display surface of the display panel 200 are both fixedly connected to the display panel 200. Similar to the foregoing contents, this arrangement is beneficial to reduce the area of the peripheral region, improve the display effect of the display apparatus 2, and have high connecting reliability, so that the risk of peeling off of the display panel 200 may be further reduced.

In some embodiments, referring to FIG. 12, the portion of the display panel 200 located in the edge bending region D2 adheres to the first support portion 210 through an adhesive layer 230. In the edge bending region D2, an outer edge JL of the adhesive layer 230 is closer to the planar region D1 than an outer edge ZL of the first support portion 210. The outer edge JL of the adhesive layer 230 is an edge of the adhesive layer 230 away from the planar region D1, and the outer edge ZL of the first support portion 210 is an edge of the first support portion 210 away from the planar region D1. Similar to the foregoing contents, this arrangement may prevent excessive stress generated in a portion of the display panel 200 that is located in the edge region and corresponds to an end of the first support portion 210 away from the planar region D1 when the display assembly 20 is bent to form a curved shape with a certain radian, so that a risk of damage to the portion of the display panel 200 due to excessive stress may be reduced, which is beneficial to improve the yield of the product.

In some embodiments, referring to FIG. 12, a thickness d1 of the first support portion 210 is approximately 2.5 to 15 times a thickness d2 of the display panel 200. For example, a thickness range of the display panel 200 is from 25 to 45 μm, inclusive, and a thickness range of the first support portion 210 is from 100 to 500 μm, inclusive. For example, the thickness d2 of the display panel 200 is approximately 40 μm, and the thickness d1 of the first support portion 210 is approximately 2.5 to 15 times the thickness of the display panel 200, e.ge, 12 times, and in this case, the thickness d1 of the first support portion 210 is approximately 480 μm. Similar to the foregoing contents, this arrangement can enable that the portion of the display panel 200 located in the edge bending region D2 will not be excessively deformed due to the press by the user's fingers, thereby not adversely affecting the display effect of the curved display apparatus 2.

In some embodiments, referring to FIG. 12, the display assembly 20 further includes a second support portion 220. The second support portion 220 is fixedly connected to a portion of the at least one first support portion 210 located in the edge bending region D2. The second support portion 220 is attached to a portion of the display panel 200 located in the planar region D1, and a material of the second support portion 220 is a rigid material. In a case where the material of the second support portion 220 is the rigid material, similar to the foregoing contents, this arrangement is able to ensure that in the planar region D1, the second support portion 220 may effectively support the display panel 200, which may avoid excessive deformation of the display panel 200 under the action of the external force, and further ensure the display effect.

In some embodiments, referring to FIG. 12, a portion of the first support portion 210 may extend to the planar region D1. Similar to the foregoing contents, this arrangement is able to reduce the difficulty of fixing a shape of the first support portion 210. Moreover, the second support portion 220 is fixedly connected to the portion of the first support portion 210 that is located in the planar region D1 and does not need to be bent. As a result, stress at a connecting position of the first support portion 210 and the second support portion 220 is small, a connecting structure is strong, and the risk of peeling off may be reduced.

The foregoing descriptions are merely specific implementations of the present disclosure, but the protection scope of the present disclosure is not limited thereto. Any changes or replacements that a person skilled in the art could conceive of within the technical scope of the present disclosure shall be included in the protection scope of the present disclosure. Therefore, the protection scope of the present disclosure shall be subject to the protection scope of the claims.

What is claimed is:

1. A display assembly having a planar region and at least one edge bending region that are connected to each other, and the display assembly comprising:

a display panel; and at least one first support portion fixedly connected to a portion of the display panel located in an edge bending region; wherein the at least one edge bending region is located in at least one edge of the display panel;

a first support portion includes a plurality of first support bars, and the plurality of first support bars are spaced apart in a width direction of the edge bending region;

shapes of side faces of the plurality of first support bars are different; and materials of the plurality of first support bars are rigid materials.

2. The display assembly according to claim 1, wherein a width of a first support bar is in a range of 0.2 mm to 1 mm, inclusive.

3. The display assembly according to claim 1, wherein the first support portion further includes a plurality of second support bars; the plurality of first support bars and the plurality of second support bars are alternately arranged in the width direction of the edge bending region, and any adjacent first support bar and second support bar are fixedly connected; and materials of the plurality of second support bars are elastic materials.

4. The display assembly according to claim 3, wherein a width of a second support bar is in a range of 0.2 mm to 1 mm, inclusive.

5. The display assembly according to claim 3, wherein the first support potion further includes at least one support layer, and a support layer is disposed on a first surface or a second surface of a whole formed by the plurality of first support bars and the plurality of second support bars, the first surface is a surface of the whole formed by the plurality of first support bars and the plurality of second support bars that is proximate to a display surface of the display panel, and the second surface is a surface of the whole formed by the plurality of first support bars and the plurality of second support bars that is away from the display surface of the display panel; and a material of the support layer is an elastic material.

6. The display assembly according to claim 5, wherein the at least one support layer and the plurality of second support bars are of an integral structure.

7. The display assembly according to claim 1, wherein the display panel is bent to a back surface of the first support portion around the first support portion, the back surface of the first support portion is a surface of the first support portion away from a display surface of the display panel, and surfaces of the first support portion that are proximate to and away from the display surface of the display panel are both fixedly connected to the display panel.

8. The display assembly according to claim 1, wherein the portion of the display panel located in the edge bending region adheres to the first support portion through an adhesive layer; and in the edge bending region, an outer edge of the adhesive layer is closer to the planar region than an outer edge of the first support portion, the outer edge of the adhesive layer is an edge of the adhesive layer away from the planar region, and the outer edge of the first support portion is an edge of the first support portion away from the planar region.

9. The display assembly according to claim 1, wherein a portion of the first support portion extends to the planar region.

10. The display assembly according to claim 1, wherein a thickness of the first support portion is approximately 2.5 to 15 times a thickness of the display panel.

11. The display assembly according to claim 1, further comprising a second support portion, wherein the second support portion is fixedly connected to a portion of the at least one first support portion located in the edge bending region, and the second support portion is attached to a portion of the display panel located in the planar region; and a material of the second support portion is a rigid material.

12. A display apparatus, comprising:

the display assembly according to claim 1;

a cover plate; and an optically clear adhesive layer located between the display assembly and the cover plate, and the cover plate and a display surface of the display assembly adhering through the optically clear adhesive layer.

13. A display assembly having a planar region and at least one edge bending region that are connected to each other, and the display assembly comprising:

a display panel; and at least one first support portion fixedly connected to a portion of the display panel located in an edge bending region; wherein the at least one edge bending region is located in at least one edge of the display panel;

the at least one first support portion is in a curved shape with a preset radian;

a material of a first support portion is an elastic material, and an elastic modulus of the first support portion is greater than an elastic modulus of the display panel.

14. The display assembly according to claim 13, wherein the display panel is bent to a back surface of the first support portion around the first support portion, the back surface of the first support portion is a surface of the first support portion away from a display surface of the display panel, and surfaces of the first support portion that are proximate to and away from the display surface of the display panel are both fixedly connected to the display panel.

15. The display assembly according to claim 13, wherein the portion of the display panel located in the edge bending region adheres to the first support portion through an adhesive layer; and in the edge bending region, an outer edge of the adhesive layer is closer to the planar region than an outer edge of the first support portion; the outer edge of the adhesive layer is an edge of the adhesive layer away from the planar region, and the outer edge of the first support portion is an edge of the first support portion away from the planar region.

16. The display assembly according to claim 13, wherein a portion of the first support portion extends to the planar region.

17. The display assembly according to claim 13, wherein a thickness of the first support portion is approximately 2.5 to 12.5 times a thickness of the display panel.

18. The display assembly according to claim 13, further comprising a second support portion, wherein the second support portion is fixedly connected to a portion of the at least one first support portion located in the edge bending region, and the second support portion is attached to a portion of the display panel located in the planar region; and a material of the second support portion is a rigid material.

19. A display apparatus, comprising:

the display assembly according to claim 13;

a cover plate; and an optically clear adhesive layer located between the display assembly and the cover plate, and the cover plate and a display surface of the display assembly adhering through the optically clear adhesive layer.

* * * * *